United States Patent [19]

Foust

[11] 4,442,893

[45] Apr. 17, 1984

[54] KICKOVER TOOL

[75] Inventor: Tommy C. Foust, Watauga, Tex.

[73] Assignee: Otis Engineering Corporation, Dallas, Tex.

[21] Appl. No.: 349,441

[22] Filed: Feb. 17, 1982

[51] Int. Cl.[3] ..... E21B 23/02

[52] U.S. Cl. ..... 166/117.5; 29/278

[58] Field of Search ..... 166/117.6, 117.5; 29/278

[56] References Cited

U.S. PATENT DOCUMENTS 4,002,203 1/1977 Terral ..... 166/117.5
4,103,740 8/1978 Yonker ..... 166/117.5
4,294,313 10/1981 Schwegman ..... 166/117.5
4,375,237 3/1983 Churchman ..... 166/117.5

*Primary Examiner*—Robert C. Watson
*Attorney, Agent, or Firm*—Vinson & Elkins

[57] ABSTRACT

A kickover tool in which the body and actuator are formed of two elongate members having flat sides held in sliding confronting relationship with a tool, carrying arm connected thereto and moved between retracted and extended position in response to relative movement between the body and actuator. A locator key is provided which has spring means urging the key to extended position which is rendered ineffective by relative movement between the body and actuator and then either the same spring or another spring is effective to urge the key towards retracted position.

15 Claims, 16 Drawing Figures

FIG. 6
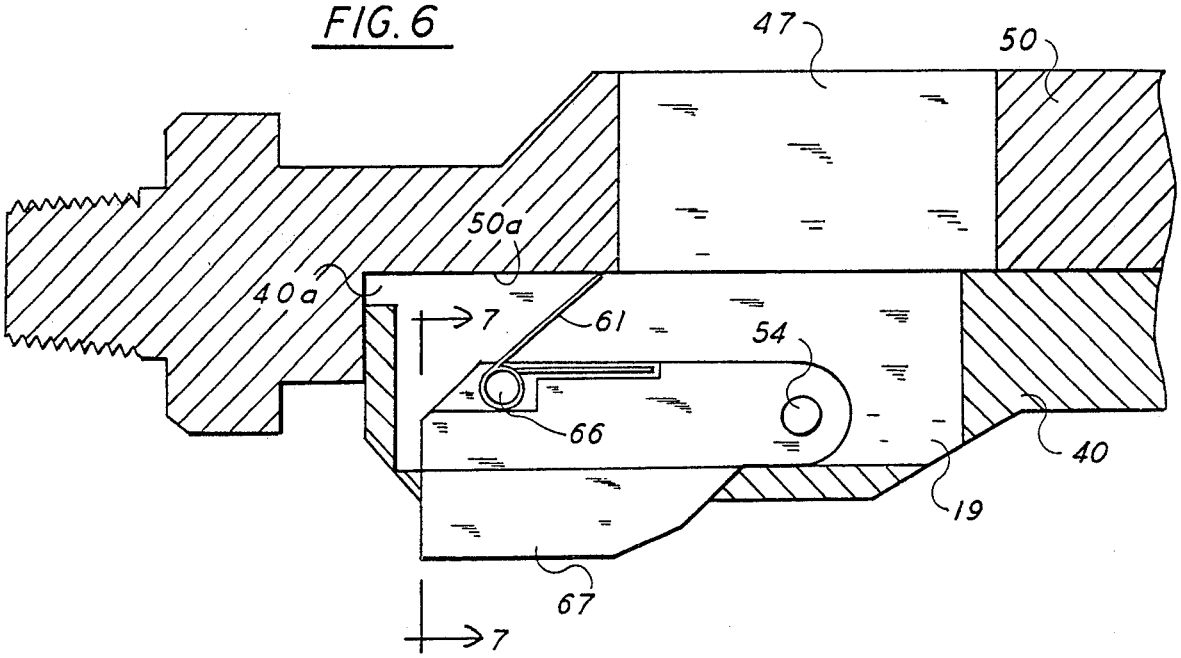
FIG. 9
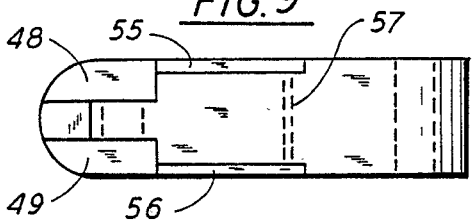
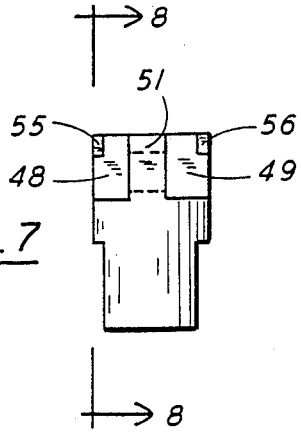
FIG. 7
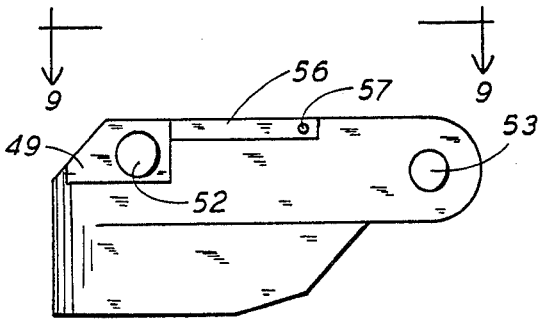
FIG. 8

KICKOVER TOOL

This invention relates to kickover tools.

In the past, many different kickover tools have been devised for landing and retrieving valves from side pocket mandrels. While the tools have taken many different forms, they have generally been characterized by having a telescoping relationship between the body of the tool and the actuator of the tool and by a key on the actuator which engaged a shoulder in the well and which was rendered ineffective after the tool had been kicked over by shearing of a pin.

When pulling a valve, a substantial force may be required and various provisions have been made to keep the kickover arm in the kickover position while pulling a valve from the valve pocket of the mandrel.

Many of these tools have been successful and are in operation today. However, they are all complex and usually fragile at one or more points.

It is an object of this invention to provide a simple rugged kickover tool which is inexpensive to manufacture.

Another object is to provide a simple rugged kickover tool in which a shear pin holds the tool in kicked over relationship so that a norm force must be applied to release the tool from the kicked over relationship.

Another object is to provide a kickover tool which, in the kicked over position, has its parts in such a relationship that the pulling force sets up a frictional resistance to the return of the kickover arm to its aligned position.

Another object is to provide an actuator key for a kickover tool which does not require the replacement of destroyed parts such as shear pin to redress the tool.

Other objects, features and advantages of the invention will be apparent from the drawings, the specification and the claims.

In the drawings wherein like numerals indicate like parts and wherein illustrative embodiments of this invention are shown:

FIG. 6 is a fragmentary view partially in cross-section and partially in elevation of a kickover tool having a modified locator key assembly;

FIG. 7 is a view along the line 7—7 of FIG. 6 of the key;

FIG. 8 is a side view of the key along the line 8—8 of FIG. 7;

FIG. 9 is a rear view of the key along the line 9—9 of FIG. 7;

Figure 1:
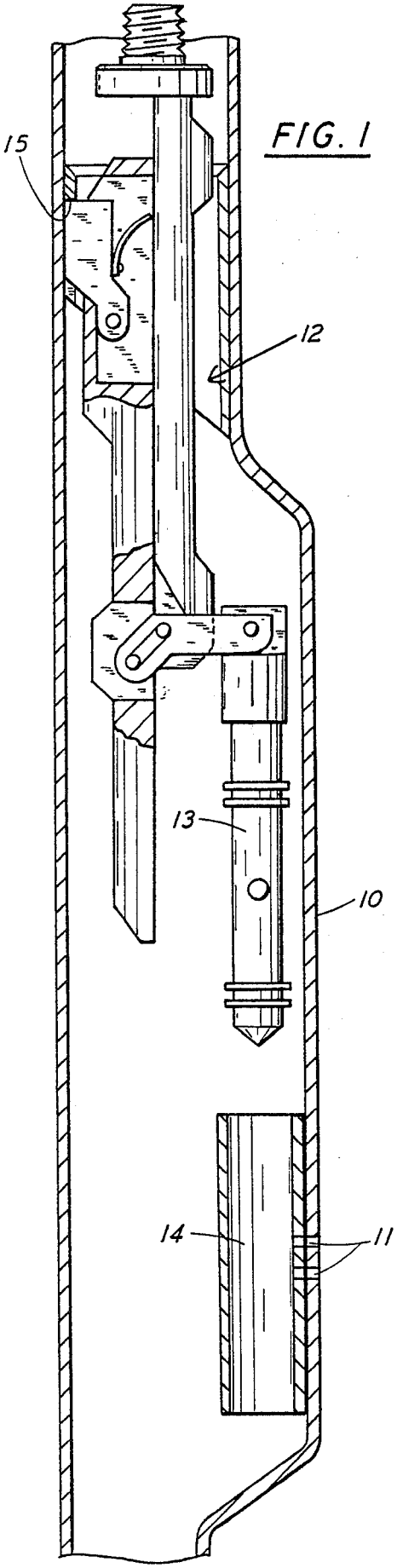
FIG. 1 is a schematic illustration of a kickover tool constructed in accordance with this invention positioned in a mandrel and in the kickover position.

Referring first to FIG. 1, a conventional side pocket mandrel 10 is illustrated. This mandrel will be made up in a well tubing in the conventional manner to provide for the introduction of gas through the ports 11 into the tubing.

The kickover tool of this invention is indicated at 12 in the kicked over position with the control valve indicated generally at 13 immediately above the valve pocket 14. The tool is run into the well in the conventional manner and raised to engage the stop 15 in a conventional muleshoe or orienting sleeve to position the tool in the kicked over position. When so positioned, the tool may be utilized to land or retrieve a valve from pocket 14. Thereafter, the raising of the tool will cause the tool to engage the top of the bulge of the mandrel 10 to move the tool from the kicked over to the aligned position and permit the tool to be withdrawn from the well.

Figure 2:
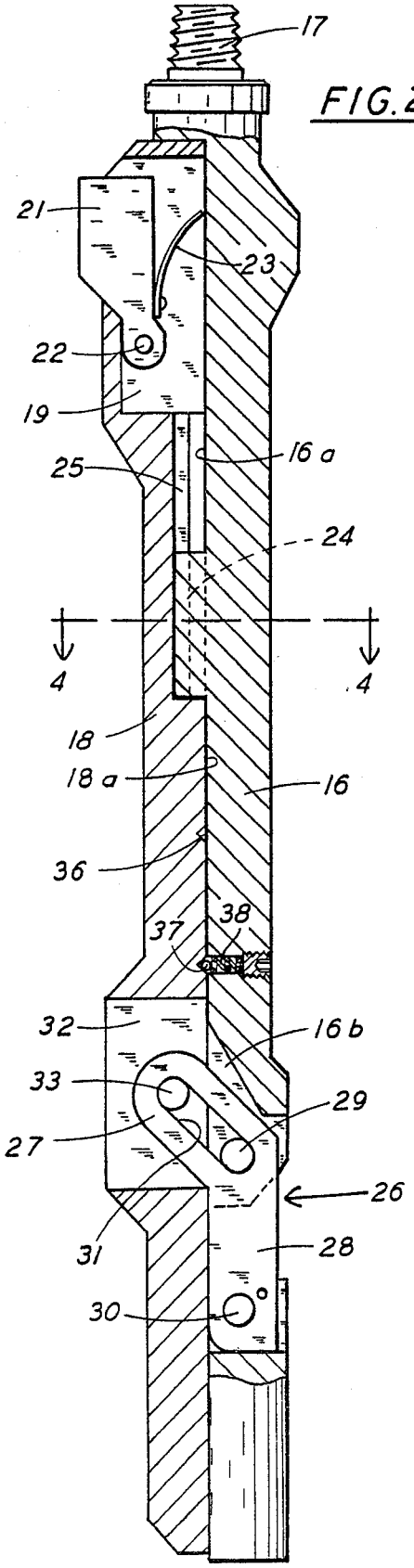
FIG. 2 is a view, partly in elevation, and partly in section showing a kickover tool constructed in accordance with this invention.
Figure 3:
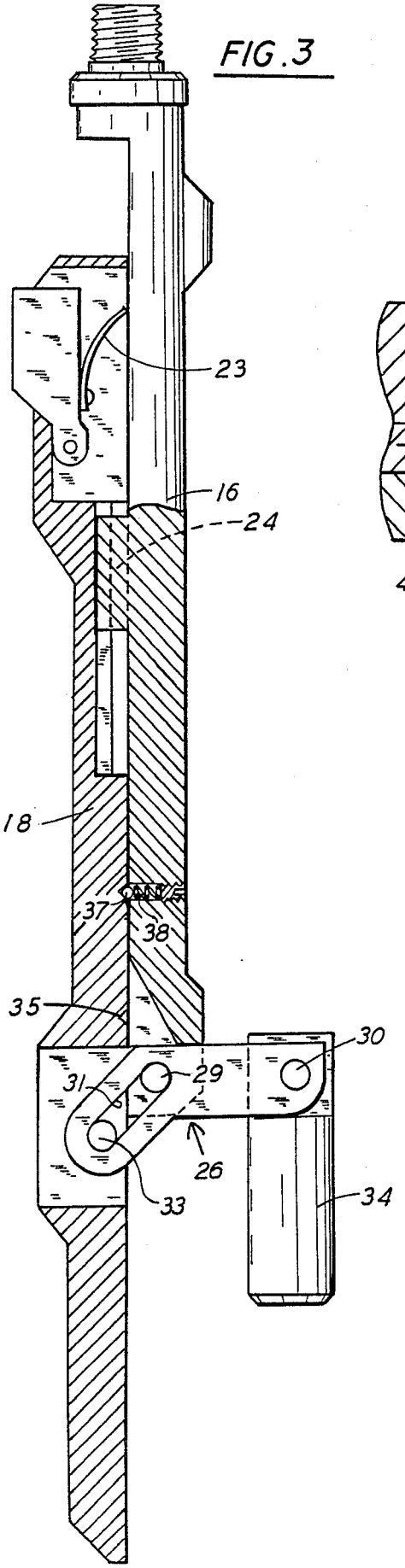
FIG. 3 is a view similar to FIG. 2 showing the tool in kicked over position.
Figure 4:
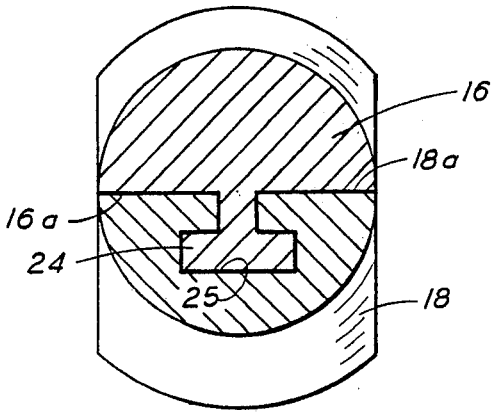
FIG. 4 is a view taken along the line 4—4 of FIG. 2.

Referring now to FIGS. 2, 3 and 4, the kickover tool includes an elongate body 16 having a flat side **16*a* and which preferably is generally semicircular in transverse section. At the upper end of the body 16, a connector 17** is provided for connecting the body to a means for running the tool such as a wire line or pump down tool string.

An elongate actuator 18 is associated with the body 16. The actuator has a flat side **18*a* and is preferably generally semicircular in transverse section as shown in FIG. 4**.

At the upper end of the actuator, a vertical slot 19 is provided and an actuator key 21 is supported in position in the slot 19 by a shear pin 22 as shown. A resilient means such as a leaf spring 23 urges the key to extended position as shown in FIG. 2 while permitting the key to retract into the slot 19 as the key strikes obstructions in the tubing when lowered in a well. The key illustrated operates in the conventional manner to engage the shoulder in the muleshoe 15 in the tubing arresting upward movement of the actuator to move the tool to kicked over position and in the conventional manner. The key is released for passing the shoulder by shearing of the pin 22 to permit the key 21 to drop into the slot 19 and disengage the shoulder.

Means are provided for slidably interconnecting the flat sides of the body 16 and the actuator 18 with these flat sides in confronting relationship. This slidable connection may be provided in any desired manner as by the tee 24 extending along an intermediate length of body 16 cooperating with a conforming T-shaped slot 25 in the actuator 18. The slot 25 is longer than the tee 24 as shown by comparison of FIGS. 2 and 3 to provide for sliding movement of the actuator relative to the body.

An arm, indicated generally at 26, has a slotted section 27 and a support section 28. The arm is pivoted to one of the body and actuator adjacent the lower end of thereof. In the preferred form, the body 16 is provided adjacent its lower end with a slot **16*b* which receives the slotted section 27 of the arm. The arm is pivoted to the body 16 by a pivot pin 29 in the body which extends through the slot section 27 and supports the arm 26**.

The slotted section 27 of the arm has a flat sided slot 31 therein through which the pivot pin 29 extends and the arm is pivotal about the pin 29. A full slot is not necessary and a short slot could be provided for either pin but a full slot is preferred for manufacturing convenience.

The actuator 18 is provided adjacent its lower end with a slot 32 into which the slotted section 27 of arm 26 extends. A pivot pin 33 carried by the actuator 31 extends through the slot 32 in the actuator 18 and through the slot 31 in the arm. Upon relative reciprocation of the body 16 and the actuator 18, their pivot pins 29 and 33 will cause the arm 26 to rotate between its in-line position shown in FIG. 4 and its kickover position shown in FIG. 3.

By reference to FIG. 3, it will be noted that with the actuator 18 in its full down position, the slot 31 extends at an angle of approximately 45 degrees to the longitudinal axis of body 16. The slot preferably rotates through an arc of 90 degrees. When an upward pull is exerted through the body 16 on the arm 26, as when a valve is being removed from the valve pocket in a mandrel, the arm will be biased to rotate about pivot pin 29. The rotational force will be applied to pivot pin 33 in the actuator 18 in a direction 45 degrees to the longitudinal axis of the body 16. It results that a substantially equal force is applied to the actuator 18 to move it to in an upward direction while at the same time moving the actuator 18 at the point of pin 33 outwardly from the body in a direction normal to the longitudinal axis of the actuator 18. Thus, a substantial frictional resistance is set up in the T-slot connection resisting return of the arm 26 to its aligned position. It has been found in a model of the tool that a steady force applied to the body 16 in an upward direction will require several hundred pounds to be applied before the arm 26 will rotate to its in-line position. It is believed that the force applied results in bending of the actuator 18 in the space between the T-slot connection and the pivot 33 until the arm 26 is able to rotate a slight distance to an angle less than 45 degrees relative to the longitudinal axis of the body. This upsets the force diagram and provides a greater force tending to move the actuator 18 upwardly as compared to the force applied laterally of the tool which is inducing the frictional relationship in the T-slot. As these forces become unbalanced, the actuator 18 will be rotated to its in-line position. Thus, in removing a valve from a valve pocket in a mandrel, the relationship of the arm and pivots permits several hundred pounds of force to be applied to remove the valve from the pocket without rotating the arm 26 thus maintaining the valve in alignment with the pocket while it is being removed therefrom. Then after the valve has been removed and the tool moves up hole far enough for the arm 26 to engage the top of the side pocket, a sufficient force may be applied to overcome the frictional resistance and rotate the arm to its in-line position. Of course, the sudden contact of the arm with the side pocket mandrel at the top thereof will set up shock waves which will release the frictional engagement and rotate the arm 26 to its in-line position at a much smaller force than required when a steady pull is applied.

The arm 26 carries at the free end of its support section, the conventional tool carrier 34 which will have secured thereto either a running tool or a pulling tool to which the valve is attached in conventional manner.

Means are provided for releasably latching the body and actuator together in a first position with the support section of the arm extending substantially in line with the body as shown in FIG. 2. This releasable latching means also latches the body and actuator together in a second position with the support section extending transversely of the body as shown in FIG. 3. Any suitable type of detent means can be utilized for this purpose. As shown in FIGS. 2 and 3, the actuator 18 may have depressions 35 and 36 therein which cooperate with the detent ball 37 which is urged towards the actuator by spring 38 held in place by a suitable screw or the like. This spring 38 may take any form such a coil spring or a stacked group of Belleville washers.

Figure 5:
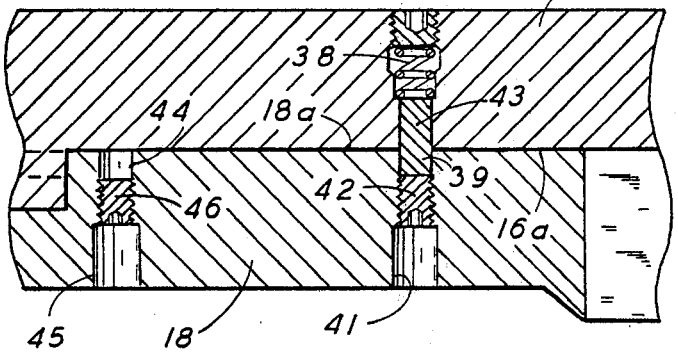
FIG. 5 is a fragmentary view in section showing an alternative form of latching means.

In an alternate form, a shear pin may be utilized in place of the detent ball 37 as shown in FIG. 5 and instead of depression 35, the actuator 18 may have a bore 39 and a counterbore 41. The bore 39 receives a removable plug 42 which, as shown has its inner end positioned below the confronting surfaces **16*a* on the body 16 and 18*a* on the actuator 18. A shear pin 43 is substituted for the detent ball 37**.

A like bore 44, counterbore 45, and plug 46 are substituted for the depression 36. FIG. 5 shows the body and actuator in the run position. As the body and actuator are moved relatively to each other, the shear pin 43 will be sheared and the portion remaining within the body 16 will slide along the confronting surface **18*a* of the actuator until it reaches the bore 44 at which time the spring 38 will force the remainder of the shear pin 43 into the bore 44 to latch the parts in the kickover position. Then when the tool is pulled up through the top of the side pocket mandrel and the arm engages the top of the mandrel and is forced to rotate clockwise as viewed in FIG. 2, the shear pin 43 will again shear and release the body and actuator to permit them to return to the position of alignment as shown in FIG. 2. While the shear pin form of latch can be designed to provide high shear forces, it does not latch the arm in the in-line position after the shear pin has been sheared and the tool returned to its FIG. 2 relationship. The use of the detent as shown in FIG. 2** permits the tool to be relatched in the in line position.

In the operation of the tool as thus far described, the tool is dressed in the FIG. 2 relationship and either a pulling or running tool is attached to the tool carrier 34. In the case of the running tool, a valve will also be attached. The tool is run in the conventional manner down to a point below the mandrel and is then raised until the key 21 engages the shoulder 15 in the mandrel. Application of a steady upward pull results in either the detent ball 37 being released or the pin 43 shearing permitting the arm 16 to rotate in a counterclockwise direction as viewed in FIG. 2 to move the arm to the fully kicked over position shown in FIG. 3. After the arm has been rotated and is detented or latched by the shear pin 43 in the kickover position of FIG. 3, the tool is lowered to either land a valve in the pocket of the side pocket mandrel or to engage a valve already in the mandrel. Then an upward pull on the tool either releases the running tool or pulls the valve from the pocket. This action is carried out with a steady force or a jar being applied and the latch provided by the detent or shear pin is augmented by the resistance to rotation of the arm provided by the relationship of the 45-degree slot and the longitudinal axis of the body as hereinabove explained. While it is preferred to use this relationship of slot and body, it is not absolutely necessary and either the shear pin or detent may be relied upon to hold the arm 26 in the kickover position of FIG. 3 until the valve has been released or removed from the pocket. Thereafter, continued upward movement of the tool causes the arm to strike the top of the bulge of the side pocket mandrel and to rotate to the in-line position of FIG. 2. This may be effected by supplying sufficient force to overcome the frictional resistance to movement between the body 16 and actuator 18 or the arm may be moved rapidly to strike a sharp blow against the top of the side pocket mandrel to induce vibrations in the several parts of the tool and permit it to readily assume the FIG. 3 position.

If desired, where the shear pin system of FIG. 5 is utilized, the kickover tool may also have an additional detent such as that provided in FIGS. 2 and 3 which will cooperate with the shear pin to resist the initial reciprocation of the body and actuator to kickover position and if desired, to assist in holding the arm in kickover position and then when the tool is returned to the in-line position function, to maintain the kickover arm in the aligned position after the pin 43 has been sheared.

While the 45 degree relationship of arm 26 to the axis of the tool will serve as a latch when the tool is in kicked over position, it is apparent that a slightly different angular relationship will also give the same results and thus a relationship of approximately 45 degrees will result in the desired latch relationship.

FIGS. 6 through 13 show one preferred form of actuator key and means for extending and retracting the key.

The body 50 is the same as body 16 except that a slot 47 extends transversely through the body.

Within the actuator key receiving slot 19 of actuator 18, there is provided a key having special provisions for supporting a resilient means. The key is generally conventional in form with the exception of the means for supporting a spring. The back side of the key adjacent its free end has slots 48 and 49 formed therein leaving an upstanding flange 51 which has a bore 52 therethrough for receiving a retaining pin 66.

At the opposite end of the key a bore 53 is provided for receiving the pivot pin 54 which pivotally supports the key on actuator 18.

Between the slots 48 and 49 and the bore 53, slots 55 and 56 are provided for receiving legs of a spring as will appear hereinafter. A bore 57 extends through the key to receive the ends of a spring as will appear hereinafter.

Figure 10:
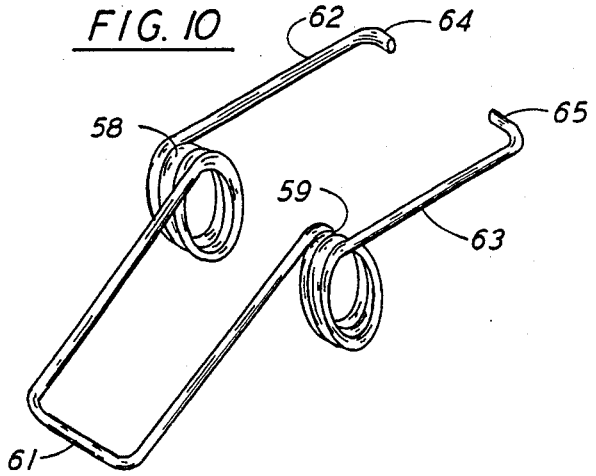
FIG. 10 is a view of the spring utilized with the actuator key of FIGS. 6 through 9.

In FIG. 10, a special spring is shown having two coil intermediate sections 58 and 59 with a continuous U-shaped leg 61 connecting the two coil sections. The free ends 62 and 63 of the spring extend in planes parallel to the legs of the U-shaped section 61 and terminate in in turned end portions 64 and 65.

In assembly, the spring is positioned on the back side of the key with the coil sections 58 and 59 on opposite sides of flange 51 and a pin 66 extends through the coils and the flange to fasten the spring in place. The legs 62 and 63 lie within the grooves 55 and 56 on the key and the two bent end portions 64 and 65 extend into the hole 57 in the key thus fixing the legs 62 and 63 to the key.

In unstressed condition, the U-shaped leg 61 of the spring extends toward the front 67 of the key and forms with the legs 62 and 63 an angle slightly in excess of 200 degrees measured clockwise from leg 61.

In assembly, the U-shaped leg 61 is forced to assume the position shown in FIG. 6 and bears against the confronting face 50*a* of the body 50. The actuator 40 has a slot 40*a* cut in the upper end thereof to cooperate with the spring as will appear from the discussion of operation of the actuator key.

Figure 11:
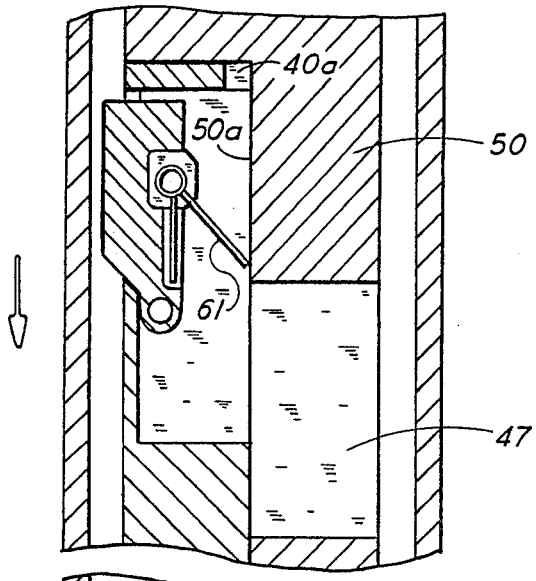
FIGS. 11, 12 and 13 are schematic views illustrating sequentially the operation of the actuator key.
Figure 12:
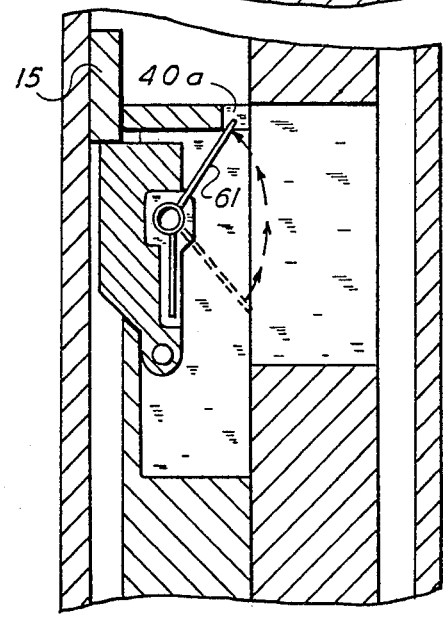
Figure 13:
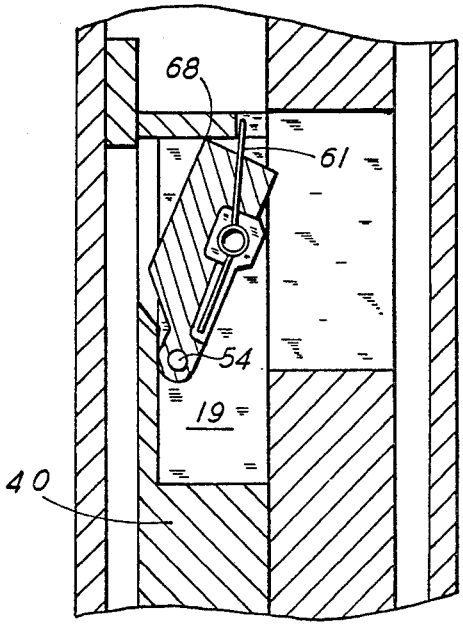

FIGS. 11, 12 and 13 illustrate the manner in which the spring controls the extension and retraction of the key. In FIG. 11, as in FIG. 6, the U-shaped leg 61 of the spring is shown to be in contact with the confronting surface 50*a* of the body 50 when the tool is in running condition with the kickover arm 26 having its support portion 28 extending along the center line of the body. When the key contacts the shoulder 15 in the mandrel, and the body moves upwardly relative to the actuator, the leg 61 extends into the slot 47 in the body and unwinds from the dotted line position shown in FIG. 12 to the solid line position where the leg 61 extends into the slot 40*a* in the top of the actuator and engages the actuator as shown. At this time, due to the upward force being exerted on the tool, the key is held against the shoulder 15 in the side pocket mandrel until the actuator and body have moved to the fully kicked over position of FIG. 3. Then, as the operator lowers the tool in the well to land or retrieve a valve, the key is moved away from shoulder 15 and the spring leg 61 rotates to the position shown in FIG. 13 and retracts the key into the actuator 40 and maintains the key in the retracted position until the tool is redressed. Thus, the key will not interfere with withdrawing the tool from the well. As the key and spring are now entirely supported within the actuator by the upper outer corner 68 of the key being held against the top of slot 19 by spring leg 61, the key becomes ineffective during future use and withdrawal of the kickover tool from the well.

Figure 15:
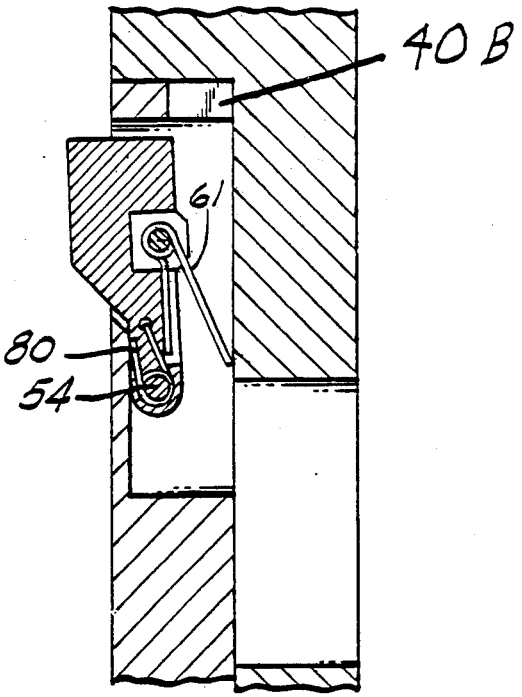
FIG. 15 is a fragmentary sectional view similar to FIG. 11 showing a modified form of the invention.
Figure 16:
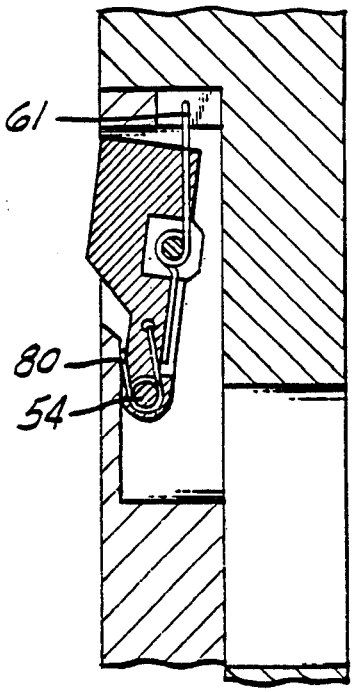
FIG. 16 is a view similar to FIG. 15 with the key in retracted position.

While a single spring accomplishing the two functions of urging the key outwardly and subsequently urging the key inwardly has been illustrated, it will be appreciated that two separate springs could be utilized to accomplish these functions. For instance, the slot 40*a* could be sufficiently large as at 40B in FIG. 15 that with the key in the FIG. 13 position, the leg 61 would not exert any force on the key as shown in FIG. 16. Then, another spring positioned in any desired manner to bear against the key and urge it to retracted position, such as a spring 80 coiled about pin 54 and bearing against the key to urge it in a clockwise direction as viewed in FIG. 16 could be utilized to retract the key. Where two springs are used, the force of the retracting spring must, of course, be less than the force of the extending spring so that the retracting spring only becomes effective upon the extending spring becoming ineffective.

Figure 14:
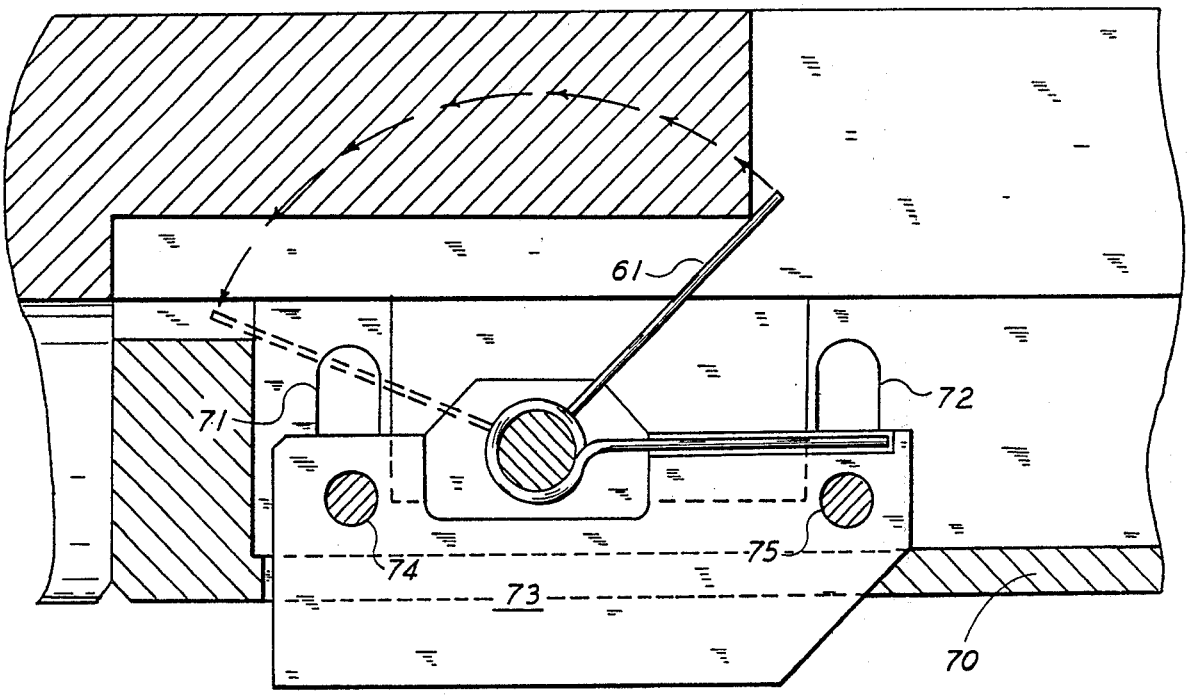
FIG. 14 is a fragmentary view partly in section and partly in elevation of a modified form of actuator key assembly.

An alternative form of actuating key is shown in FIG. 14. This key differs only from the previously described key in that the key slides in two tracks instead of being rotated about a pivot.

In the alternative form of key, the actuator 70 has a pair of spaced slots 71 and 72 therein. The actuator key 73 has a pair of pins 74 and 75 which reciprocate in the slots 71 and 72 permitting the key to be retracted and extended relative to the actuator 70.

The key may be contoured to receive the spring in the same manner as shown in FIGS. 7, 8 and 9 and the leg 61 of the key will engage the body in the same manner as before explained.

The only difference in function between the key of FIG. 14 and the other key, is that the force exerted by the spring slides the key 73 in the slots 71 and 72 instead of rotating the keys about a pivot pin as shown in FIG. 6.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. A kickover tool comprising, an elongate body having a flat side and connector at its upper end, an elongate actuator having a flat side and locator key at its upper end, means slidably interconnecting the flat sides of said body and actuator in confronting relationship, an arm pivoted to one of said body and actuator adjacent its lower end, said arm having a support section, a tool carrier pivoted to the free end of said support section of said arm, means between said arm and the other of said body and actuator moving said arm between a position substantially coaxial with said body and a position transverse thereof, and means releasably latching said body and actuator together in a first position with said support section extending substantially aligned with said body and in a second position with said support section extending transverse of said body.

2. The tool of claim 1 wherein said releasable means is a shear pin carried by one of said body and actuator and engageable with the other of said body and actuator to place said pin in shear, and means urging said shear pin towards the other of said body and actuator.

3. The tool of claims 1 or 2 wherein said slidable connection is provided by a T-shaped member on one of said body and actuator and a co-engaging T-shaped slot on the other of said body and actuator.

4. The tool of claims 1, or 2 wherein spring means urges said key towards extended position, means renders said spring means ineffective to urge the key towards extended position in response to relative movement of said actuator and body from arm retracted to arm extended position, and said spring means is effective upon said relative movement of said actuator and body to arm extending position to urge said key towards retracted position.

5. A kickover tool comprising, an elongate body having a flat side, said body having a connector at its upper end and a pivot pin at its lower end, an elongate actuator having a flat side, said actuator having a locator key at its upper end and a pivot pin at its lower end, means slidably interconnecting the flat sides of said body and actuator in confronting relationship, an arm having a section with a flat sided slot therein receiving said two pivot pins and a support section extending from said slotted section, a tool carrier pivoted to the free end of said support section, and means releasably latching said body and actuator together in a first position with said support section extending substantially coaxial with said body and in a second position with said support section extending transverse of said body.

6. The tool of claim 5 wherein said slot extends at approximately a forty-five degree angle to the elongate body when said latch means latches said body and actuator with the support section of said arm extending transverse of said body.

7. The tool of claim 5 wherein said slot rotates through an angle of approximately ninety degrees as said body and actuator move relative to each other between said first and second positions.

8. The tool of claim 5 wherein said slidable connection is provided by a T-shaped member on one of said body and actuator and a co-engageable T-shaped slot on the other of said body and actuator.

9. The tool of claims 5, 6, 7 or 8 wherein said releasable means is a shear pin carried by one of said body and actuator and engageable with the other of said body and actuator to place said pin in shear, and means urging said shear pin towards the other of said body and actuator.

10. The tool of claims 5, 6, 7, or 8 wherein spring means urges said key towards extended position, means render said spring means ineffective to urge said key towards extended position in response to relative movement of said actuator and body from arm retracted to arm extended position, and said spring means effective upon said relative movement of said actuator and body to arm extended position to urge said key towards retracted position.

11. The tool of claim 10 wherein said spring means includes two springs and after the first spring is rendered ineffective the second spring is effective to move the key to retracted position.

12. The tool of claim 11 wherein said spring means is a single spring having a leg bearing against said body while urging said key towards extended position, said body has a slot therein into which side leg extends to render it ineffective as the body and actuator move towards arm extended position, and said actuator has a shoulder engaged by said leg as the body and actuator move to full arm extended position, said leg when engaging said shoulder rendering said spring effective to urge the key towards retracted position.

13. A kickover tool comprising, an elongate body, an elongate actuator slidable relative to the body, an arm connected to at least one of the body and actuator and movable from retracted to extended position in response to relative sliding movement of said body and actuator, a locator key carried by said actuator and movable laterally of the actuator between a retracted position and an extended position, spring means urging said key towards extended position, means rendering said spring means ineffective to urge said key towards extended position in response to relative movement of said actuator and body from arm retracted to arm extended position, and said spring means is effective upon said relative movement of said actuator and body to arm extended position to urge said key towards retracted position.

14. The tool of claim 13 wherein said spring means includes two springs and after the first spring is rendered ineffective the second spring is effective to move the key to retracted position.

15. The tool of claim 13 wherein said spring means is a single spring having a leg bearing against said body while urging said key towards extended position, said body has a slot therein into which said leg extends to render it ineffective as the body and actuator move towards arm extended position, and said actuator has a shoulder engaged by said leg as the body and actuator move relatively to full arm extended position, said leg when engaging said shoulder rendering said spring effective to urge the key towards retracted position.

* * * * *